US005893421A

United States Patent [19]

Lemmetty

[11] Patent Number: 5,893,421

[45] Date of Patent: Apr. 13, 1999

[54] ARRANGEMENT FOR MOUNTING SWING CYLINDERS IN BOOM FOR ROCK DRILLING UNIT

[75] Inventor: Pauli Lemmetty, Tampere, Finland

[73] Assignee: Tamrock Oy, Tampere, Finland

[21] Appl. No.: 08/776,946

[22] PCT Filed: Aug. 28, 1995

[86] PCT No.: PCT/FI95/00458

§ 371 Date: Feb. 14, 1997

§ 102(e) Date: Feb. 14, 1997

[87] PCT Pub. No.: WO96/07014

PCT Pub. Date: Mar. 7, 1996

[30] Foreign Application Priority Data

Aug. 30, 1994 [FI] Finland ..... 943978

[51] Int. Cl.[6] ..... E21B 15/04

[52] U.S. Cl. ..... 173/193

[58] Field of Search ..... 173/190, 192, 173/193, 194, 195, 184, 42, 44, 4, 11, 13

[56] References Cited

U.S. PATENT DOCUMENTS

| | | | |
|---|---|---|---|
| 3,493,200 | 2/1970 | Huffman . | |
| 3,918,536 | 11/1975 | Deeter et al. | 173/164 |
| 3,980,142 | 9/1976 | Grigoriev et al. | 173/193 |
| 3,999,805 | 12/1976 | Lockwood | 173/193 |
| 4,190,117 | 2/1980 | MacLean | 173/193 |
| 4,193,459 | 3/1980 | Engstrom . | |
| 4,343,367 | 8/1982 | Mashimo | 173/190 |
| 4,484,637 | 11/1984 | Mayer | 173/190 |
| 4,508,035 | 4/1985 | Mashimo et al. | 173/11 |
| 4,542,794 | 9/1985 | Bjor | 173/193 |
| 4,601,000 | 7/1986 | Montabert | 173/11 |
| 5,529,132 | 6/1996 | Evarts | 173/4 |

FOREIGN PATENT DOCUMENTS

| | | |
|---|---|---|
| 0 140 873 | 5/1985 | European Pat. Off. . |
| 3903302 C1 | 4/1990 | Germany . |

*Primary Examiner*—Jessica J. Harrison
*Assistant Examiner*—John Paradiso
*Attorney, Agent, or Firm*—Nixon & Vanderhye P.C.

[57] ABSTRACT

An arrangement for mounting swing cylinders in a boom for a rock drilling unit which includes a frame, a boom pivotally connected about vertical and horizontal shafts, relative to the frame, a lift cylinder connected between the frame and the boom, and a swing cylinder connected between the frame and the boom. The unit also includes a support for a feed beam, pivotally connected to the other end of the boom about horizontal and vertical shafts, a tilt cylinder, connected between the support and the boom, and a transverse swing cylinder connected between the support and the boom. The swing cylinder is coupled at an angle (α), relative to the longitudinal axis of the boom, such that the longitudinal axis of the swing cylinder has a downward inclination from the frame toward the opposite end of the boom, so that with the boom in the middle of its upper and lower angles of altitude, the swing cylinder is essentially horizontal.

5 Claims, 2 Drawing Sheets

ARRANGEMENT FOR MOUNTING SWING CYLINDERS IN BOOM FOR ROCK DRILLING UNIT

BACKGROUND AND SUMMARY OF THE INVENTION

The invention relates to an arrangement for mounting swing cylinders in a boom for a rock drilling unit, comprising a frame, a boom pivotally connected about vertical and horizontal shafts, relative to the frame, a lift cylinder connected between the frame and the boom for vertical lifting and lowering of the boom, a swing cylinder connected between the frame and the boom for lateral turning of the boom relative to the frame, a support for a feed beam, connected to the other end of the boom pivotally about horizontal and vertical shafts, a tilt cylinder, connected between the support and the boom for turning the support relative to the boom about a horizontal shaft, and a transverse swing cylinder connected between the boom and the support for turning the support relative to the boom about a vertical shaft.

A problem with booms for rock drilling units is that when a feed beam is vertically turned when simultaneously being laterally deviated from its upright position to either side, the end of the boom moves so as to describe an arc. The greater the upward or downward movement of the boom, the greater the simultaneous lateral outward swing. This is caused by the articulated structures of a boom and the consequent structural geometry, the elimination of which has in practice proved impossible by mechanical means. A weakness of known solutions is also that the upward and downward swing angles of booms are not symmetrical; the downward angle is narrower than the upward angle for practical reasons. Consequently the lateral deviation in both angular positions of a boom is far too large to be handled and causes much inconvenience when the boom is used. When the boom is allowed to turn to its extreme lateral angles being in its upper angular position, the joints of the cylinders may shift to a position where the boom no longer can turn back, but is locked in place.

The object of this invention is to provide an arrangement with optimum elimination of the above problems and with as equal a lateral swing as possible in the upper and lower vertical positions of a boom. The arrangement of the invention is characterized in that a swing cylinder between a frame and a boom is coupled at an angle relative to the longitudinal axis of the boom so that the longitudinal axis of the swing cylinder has a vertical downward inclination from the frame toward the end of the boom, relative to the direction of the longitudinal axis of the boom, and that the centres of the horizontal joints, relative to the base, of the swing cylinder and the boom are essentially united with each other at the base of the boom when the boom faces straight ahead relative to the frame.

An essential idea of the invention is that the swing cylinder is coupled vertically inclined relative to the longitudinal axis of the boom so that with the swing cylinder in the horizontal plane, the boom is in the middle of its vertical swing range, whereat the upward or downward swinging of the boom from this position causes an equal deviation in both the extreme upper and lower positions to the lateral swing of the boom because of the position of the swing cylinder. Correspondingly, the transverse swing cylinder needed for turning the feed beam is coupled at an angle to the longitudinal axis of the boom, whereat the turning of both the feed beam and the boom results in equal angular changes by the action of the vertical swing angle.

It is an advantage of the invention that the changes in the direction and lateral deviations of both the boom and the feed beam, when vertically turned, are essentially the same relative to the horizontal plane both above and below, as the angles between the longitudinal axis of the boom and the swing cylinder, and correspondingly the transverse swing cylinder, compensate for the vertical deviations of the boom.

The invention will be described in greater detail below, in connection with the accompanying drawings.

DETAILED DESCRIPTION OF THE DRAWINGS

Figure 1A:
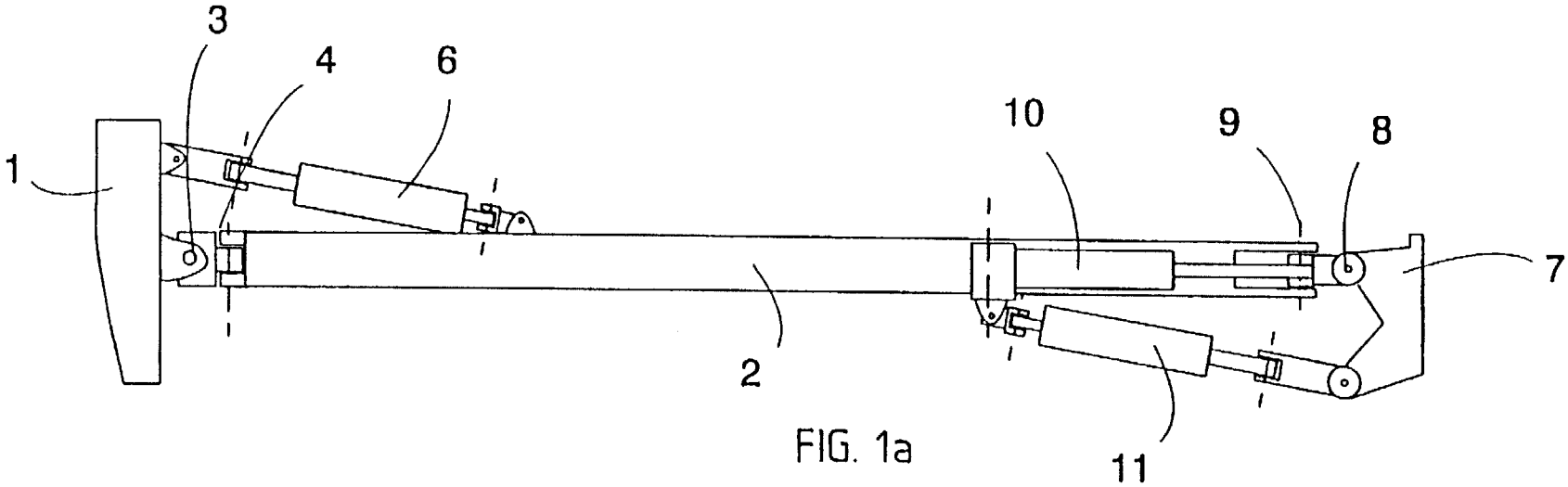
FIG. 1*a* is a schematic top view of an arrangement of the invention.
Figure 1B:
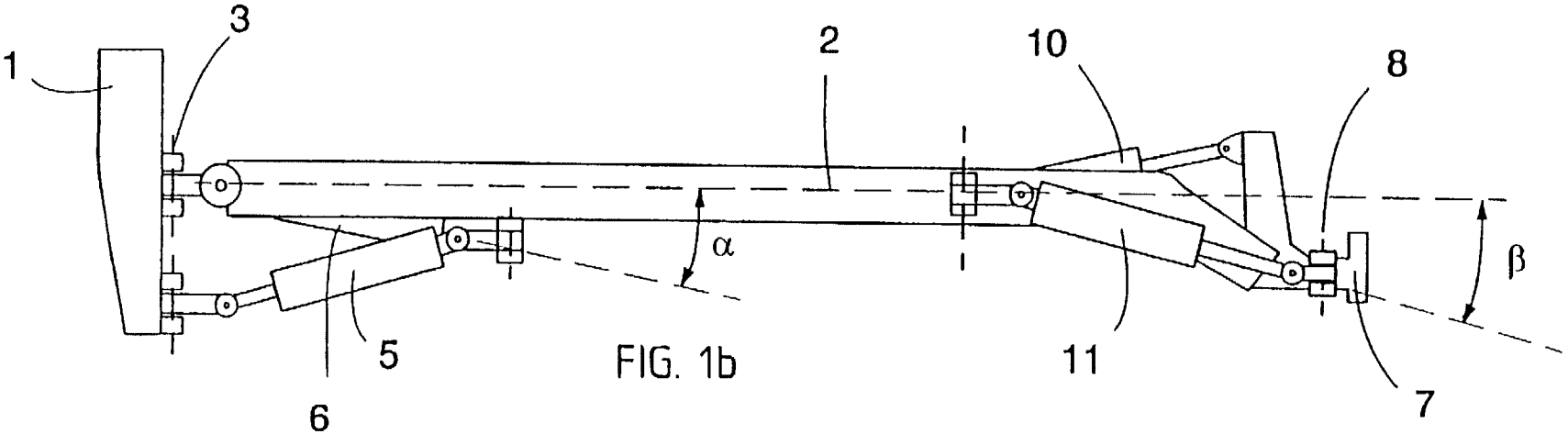
FIG. 1*b* is a schematic side view of an arrangement of the invention.

FIG. 1*a* schematically shows a part of a frame 1, comprising a boom 2 for a rock drilling unit, pivotally connected about a vertical shaft 3 and a horizontal shaft 4. A lift cylinder 5, not shown in the Figure, is pivotally connected at both ends between the frame 1 and the boom 2, and is shown in FIG. 1*b*, inclined from the boom 2 downward toward the frame 1. Between the boom 2 and the frame 1, a swing cylinder 6 is pivotally connected at the ends to the frame 1 and the boom 2. Cylinders 5 and 6 are both coupled so as to be able to turn relative to the frame 1 and the boom 2, in both the vertical and horizontal planes. Such an articulated coupling is generally known per se, and will not be described in any greater detail. A support 7 is at the end of the boom 2 for fixing a feed beam to the end of the boom 2. The support 7 is pivotally connected at the end of the boom 2 about a vertical shaft 8 and a horizontal shaft 9. FIG. 1 further shows a tilt cylinder 10, pivotally connected between the boom 2 and the support 7 at both its ends for vertical lifting of the support 7 and, therewith the feed beam, relative to the boom 2. The Figure also shows a transverse swing cylinder 11, pivotally connected at its ends between the boom 2 and the support 7 for swinging the support 7 about the vertical shaft 8 irrespective of its vertical angle.

FIG. 1*b* correspondingly shows a side view of the arrangement of FIG. 1*a*. The Figure shows that the swing cylinder 6 and the transverse swing cylinder 11 are inclined toward the direction of the longitudinal axis of the boom 2 and further at a downward angle relative to the end of the boom 2. With the boom 2 in the horizontal plane, the vertical angular difference of the swing cylinder 6 is $\alpha$, preferably, in a manner shown in greater detail in FIG. 2, half the difference between the vertical uppermost and lowermost swing angles of the boom 2. Correspondingly, the vertical angle between the longitudinal axes of the transverse swing cylinder 11 and the boom 2, $\beta$, is half the difference between the vertically turnable extreme angles of the support 7. Typically the angles $\alpha$ and $\beta$ are equal, but may also be unequal.

Figure 2:
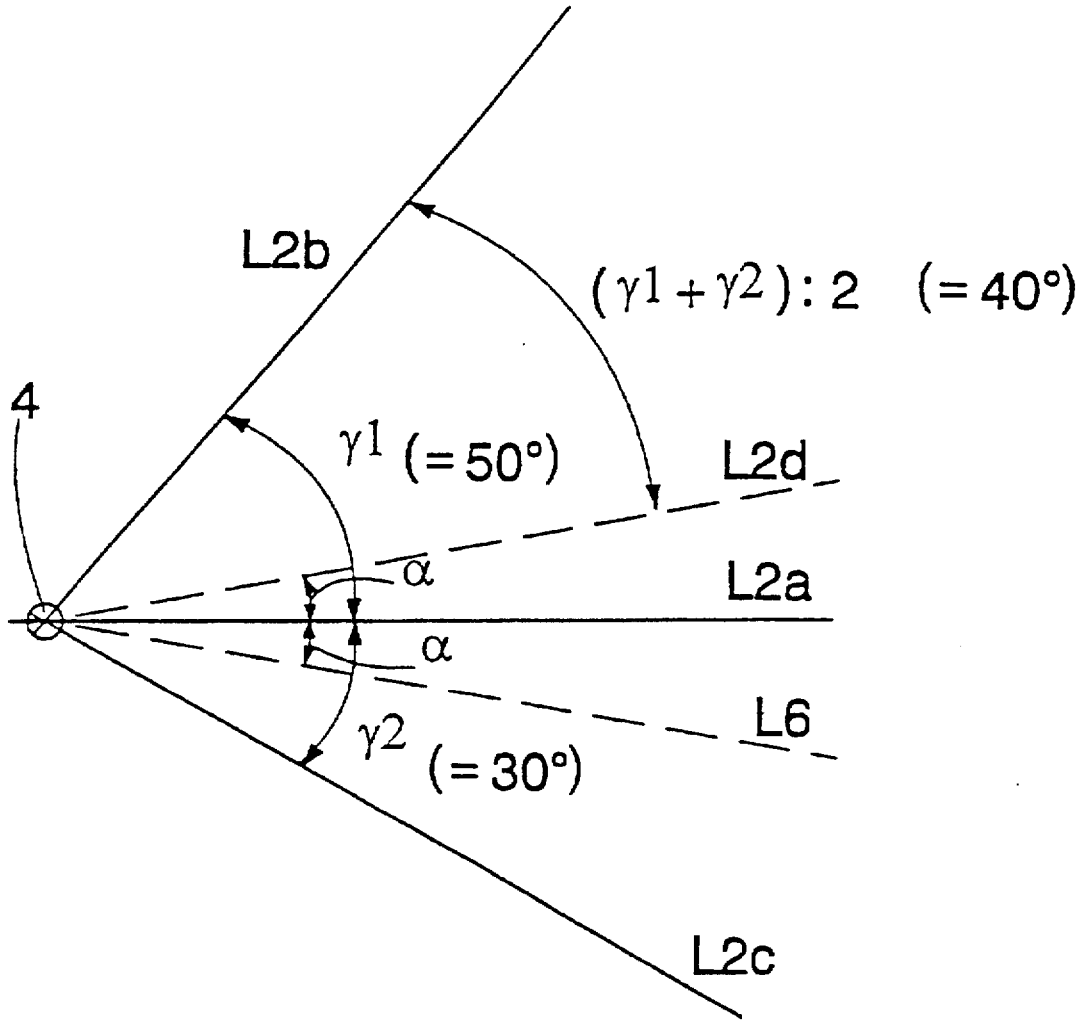
FIG. 2 schematically shows the boom geometry of the arrangement of the invention by way of an example.

FIG. 2 schematically shows the ratio between the vertical angles of the boom 2 and the angles of the swing cylinder 6. Line L2*a* refers to the direction of the longitudinal axis of the boom with the boom 2 in the horizontal plane, line L2*b* refers to the direction of the longitudinal axis of the boom with the boom 2 lifted vertically to the farthest possible upward position, and line L2*c* refers to the longitudinal axis of the boom with the boom 2 vertically turned to the farthest possible downward position. Typically the angle of elevation of the boom 2 upward is greater than downward, and this has been illustrated by allocating the value 50° to the upper angle of altitude γ1 and the value 30° to the lower angle of altitude γ2. In order to obtain equal lateral deviations of the end of the boom 2, irrespective of the lateral swing angle, in the extreme positions of both the upper and lower angles of altitude, the effect of the swing cylinder 6 must be made symmetrical. This is accomplished by an angle α, between the longitudinal axis L6 of the swing cylinder 6 and the longitudinal axis of the boom 2, being wide enough for the swing cylinder 6 to become essentially horizontal while the boom 2 is swung to the middle of the extreme limits **L2*b* and L2*c*, to line L2*d*. Consequently, when completely equal deviations both in the upper and lower directions are required, the value of the angle α is half the difference between the upper swing angle γ1 and the lower swing angle γ2, i.e. in the case shown in the Figure, (50°−30°):2=10°. Thus, with the boom 2 in the horizontal plane in accordance with the line L2*a*, the downward position of the swing cylinder 6 below it, from the joint between the boom 2 and the frame, equals the value of the angle α, i.e. in the case shown in the Figure, 10°. Correspondingly, with the swing cylinder 6 horizontal, i.e. parallel with the line L2*a*, a resulting upward movement of the boom equals the value of the angle α, i.e. the boom is parallel with the line L2*d*. The inclination β of the transverse swing cylinder 11 of the support 7 supporting the feed beam is defined similarly, and is at its simplest implementation equal to α. As is evident from the Figures, the joints of the swing cylinder and the boom are essentially aligned relative to the frame 1 when the boom 2 faces straight ahead relative to the frame 1**. Thus the centres of the horizontal joints at the base of the boom are essentially united with each other in this situation, although small structural differences may exist. Similarly, when the feed beam is required to turn correspondingly as precisely as possible, the measurements of the feed beam or its horizontal joints are arranged so that the centres of these horizontal joints are essentially united. It is naturally clear that when the boom turns laterally, the turning of the centres of the joints causes therein a certain deviation, relative to each other, from their original position, which results in a small error owing to the structure of the mechanism. This, however, has no essential significance as to the invention, as the movements of the boom are, however, essentially symmetric above and below the middle of the vertical swing angle of the boom.

In the above description and in the drawings the invention has been described only by way of example, and it is by no means to be so restricted.

What is claimed is:

1. An arrangement for mounting swing cylinders in a boom for a rock drilling unit comprising: a frame, a boom pivotally connected at one end to the frame for rotation relative to the frame about first vertical and horizontal shafts, a lift cylinder connected between the frame and the boom for vertical lifting and lowering of the boom about the first horizontal shaft; a swing cylinder connected between the frame and the boom for lateral turning of the boom relative to the frame about said first vertical shaft; a support for a feed beam, connected to an opposite end of the boom for pivotal movement about second horizontal and vertical shafts; a tilt cylinder connected between the support and the boom for turning the support relative to the boom about the second horizontal shaft; and a transverse swing cylinder connected between the boom and the support for turning the support relative to the boom about the second vertical shaft; wherein the swing cylinder between the frame and the boom is coupled at an angle (α) relative to a longitudinal axis of the boom such that a longitudinal axis of the swing cylinder has a downward inclination from the frame toward the opposite end of the boom, relative to the direction of the longitudinal axis of the boom, and wherein centers of said first and second horizontal shafts of the swing cylinder and the boom are substantially aligned with each other at the said one end of the boom when the boom faces straight ahead relative to the frame.

2. An arrangement as claimed in claim 1, wherein the angle (α) between the longitudinal axes of the swing cylinder and the boom is in a vertical plane and is equal to substantially half the difference between an upper swing angle and a lower swing angle of the boom relative to a horizontal plane.

3. An arrangement as claimed in claim 1, wherein the transverse swing cylinder between the boom and the support is coupled relative to the longitudinal axis of the boom at an angle (β) between the longitudinal axis of the boom and a longitudinal axis of the transverse swing cylinder, said angle (β) inclined downwardly in a direction toward said opposite end of the boom.

4. An arrangement as claimed in claim 3, wherein the angle (β) is in a vertical plane and is equal to half the difference between upward and downward swing angles of the support relative to the boom.

5. An arrangement as claimed in claim 3 wherein the angles (α) and (β) are equal.

* * * * *